US005617519A

United States Patent [19]

Herbert

[11] Patent Number: 5,617,519

[45] Date of Patent: Apr. 1, 1997

[54] FRANKING MACHINE

[75] Inventor: Raymond J. Herbert, Leigh-on-Sea, United Kingdom

[73] Assignee: Neopost Limited, Essex, United Kingdom

[21] Appl. No.: 169,360

[22] Filed: Dec. 20, 1993

[30] Foreign Application Priority Data

Dec. 23, 1992 [GB] United Kingdom ..... 9226811

[51] Int. Cl.[6] ..... G07B 17/00

[52] U.S. Cl. ..... 395/117; 364/464.18

[58] Field of Search ..... 395/112, 117; 346/140; 364/464.02, 464; 235/375

[56] References Cited

U.S. PATENT DOCUMENTS

| | | | |
|---|---|---|---|
| 4,611,232 | 9/1986 | Searby | 358/335 |
| 4,992,959 | 2/1991 | Hamada et al. | 364/519 |
| 5,038,153 | 8/1991 | Liechti et al. | 346/140 |
| 5,111,030 | 5/1992 | Brasington et al. | 235/375 |
| 5,233,657 | 8/1993 | Günther | 380/23 |
| 5,243,691 | 9/1993 | Kuwatara et al. | 395/112 |
| 5,257,197 | 10/1993 | Günther et al. | 364/464 |

FOREIGN PATENT DOCUMENTS

| | | | |
|---|---|---|---|
| 2247376 | 2/1992 | United Kingdom . | |
| 224737 | 2/1992 | United Kingdom | H04N 1/10 |

*Primary Examiner*—Raymond J. Bayerl
*Assistant Examiner*—Steven P. Sax
*Attorney, Agent, or Firm*—Shoemaker and Mattare, Ltd.

[57] ABSTRACT

A franking machine is provided with a memory to store slogan print data and scanning means whereby a medium bearing a slogan desired to be printed is fed by mail item feed means of the franking machine past the scanning means to generate slogan print data to be written to the slogan memory. During subsequent franking operations, the slogan print data is read from memory to control a franking impression printer to print the slogan alongside the franking impression. A plurality of memories may be provided for storing a plurality of slogans and a selected slogan may be read from a selected one of the memories.

5 Claims, 2 Drawing Sheets

FRANKING MACHINE

BACKGROUND OF THE INVENTION

This invention relates to franking machines and in particular to franking machines having provision for printing a slogan on mail items at the time of printing alongside a franking impression on the mail item.

In known franking machines, a rotatable print drum carries a die for printing invariable parts of a franking impression and settable print wheels for printing variable information in the franking impression. The variable information comprises a value of postage charge for the franking and the date on which the franking is effected. In addition to the die for printing the invariable part of the franking impression the print drum carries a further die for printing a slogan. The die for printing the slogan is usually fitted during manufacture of the franking machine and if it is desired to change the slogan after the franking machine has been installed in the field at a user's location it is necessary to manufacture a new die formed to print the new slogan and for this new die to be fitted by a service engineer. Accordingly the information printed as the slogan is chosen such as not to require changing or maybe only infrequent changing. However it would be convenient for at least some users of franking machine to be able to print different slogans in accordance with changing circumstances. For example it may be desired to print a slogan appropriate to a time of year, for example Christmas, or a slogan relating a product marketed by the user or even a slogan appropriate to a specific group of recipients of the mail items.

SUMMARIES OF THE INVENTION

According to one aspect of the present invention a franking machine includes electronic accounting and control circuits and a digital printing device; feed means to feed items past the print device; said printing device being controlled by said circuits to print franking impressions and slogans on mail items fed by said feed means; memory means to store data defining a current slogan to be printed by said printing device; sensing means operable to sense a new slogan carried by an input item fed by said feed means and to output sense signals defining said sensed slogan; and said circuits including circuit means to store said sense signals in said memory to be utilised as data defining a current slogan to be printed.

According to a second aspect of the present invention a method of printing impressions including a franking impression of postage information and a slogan by means of a franking machine including feed means to feed mail items past impression printing means comprises the steps of providing the franking machine with slogan storage means; utilising the feed means to feed a medium bearing a slogan to be included in the franking impressions past slogan scanning means to generate slogan print data and storing said slogan print data in the slogan storage means; and, in franking operations to print impressions on mail items, reading said slogan print data from said slogan storage means and utilising said slogan print data to control the impression printing means to print said slogan together with the franking impression during feeding of mail items by said feed means.

BRIEF DESCRIPTION OF THE DRAWING

An embodiment of the invention will now be described by way of example with reference to the drawings in which.

DESCRIPTION OF THE PREFERRED EMBODIMENT

Figure 1:
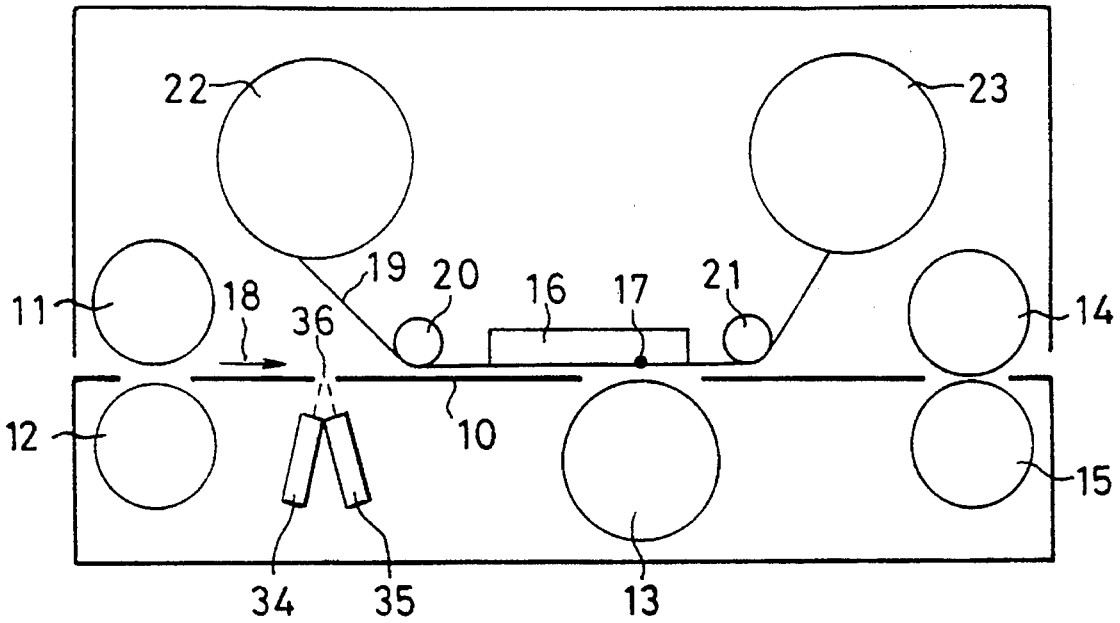
FIG. 1 is a schematic diagram of a franking machine illustrating the physical relationship of elements of the machine.

Referring first to FIG. 1, a franking machine is provided with a feed bed 10 along which mail items are fed seriatim in the direction of arrow 18 by a pair of input feed rollers 11, 12, an impression roller 13 and a pair of ejection rollers 14, 15. A thermal print head 16 is disposed opposite the impression roller such that mail items fed along the feed bed 10 pass between the impression roller and the print head. The thermal print head has a plurality of thermal print elements 17 located in a row extending transversely to the direction of feed of the mail items.

A thermal transfer ink ribbon 19 is guided by guides 20, 21 from a supply spool or reel 22, past the thermal printing elements 17 to a take up spool or reel 23. The ink ribbon passes between the mail item and the thermal printing elements. The ink ribbon has a substrate film carrying a thermally transferable ink layer. The ribbon is orientated such that the substrate film lies against the thermal printing elements and the ink layer is in ink transfer engagement with the surface of the mail item to receive the print impression. The row of thermal printing elements is aligned with the impression roller. The impression roller is resiliently mounted to permit movement of the impression roller toward and away from the print head so as to accommodate mail items of different thickness. Spring means (not shown) is provided to urge the impression roller toward the thermal print elements so as to apply pressure to the mail item and thereby maintain the surface of the mail item in ink transfer engagement with the ink layer of the ribbon and to maintain the ribbon in heat transfer relationship with the thermal printing elements.

Figure 2:
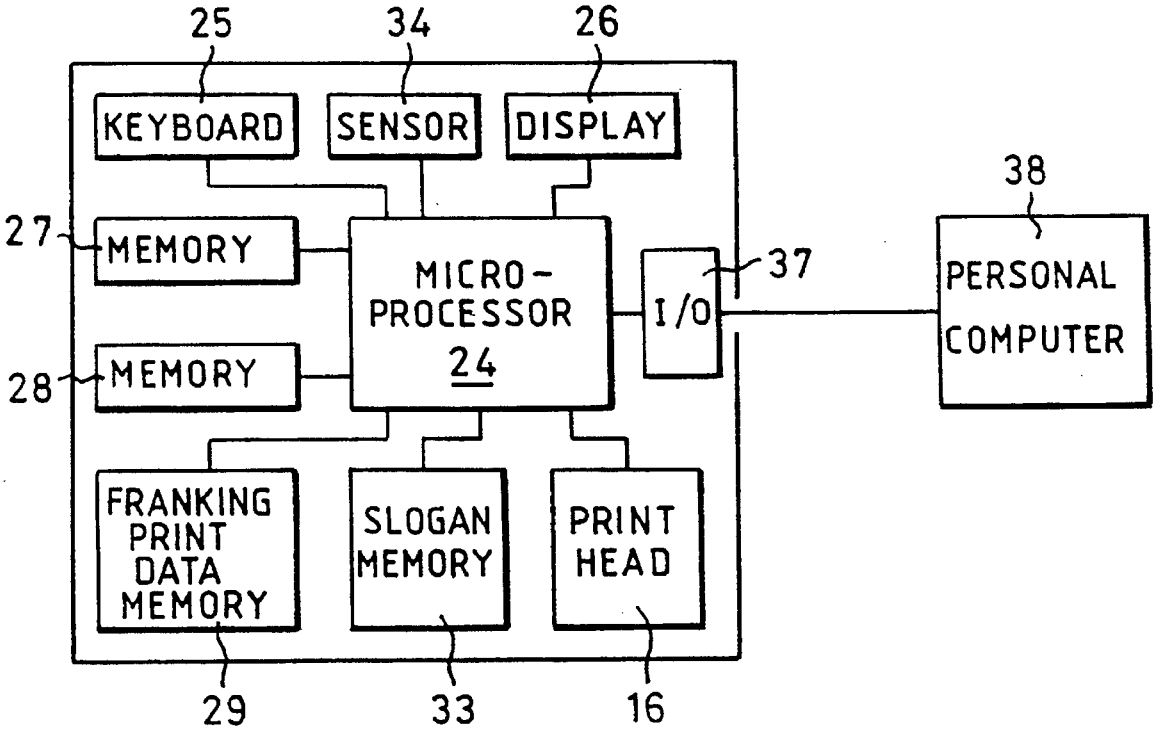
FIG. 2 is a block diagram illustrating the electronic circuits of the franking machine.

Referring now to FIG. 2 which shows the electronic circuit blocks of a franking machine, a microprocessor 24 carries out accounting functions and controls operation of the printing head 16 to print a franking impression and a slogan on a mail item such as envelope. A keyboard 25 enables input of information and control signals to the microprocessor by a user of the franking machine and a display 26 driven by the microprocessor provides information relating to operation of the franking machine to the user. Non-volatile memory devices are provided to store accounting records relating to usage of the franking machine in franking mail items. The memory devices have storage locations providing a descending register to store a value of credit available for use in franking, an ascending register to store an accumulated value of postage used in franking mail items, an items register to store a count of the number of items franked and a high items register to store a count of the number of items franked with a postage charge in excess of a predetermined value. In order to ensure security and integrity of the accounting data and to enable reliable restoration of the accounting data in the event of a fault occurring each of the registers is duplicated in each of the memory devices 27, 28. The print head 16 is connected to the microprocessor 24 and is controlled by the microprocessor to print required information on the mail items. The printing device is a digital printing device in which the plurality of printing elements are selectively operable by signals from the microprocessor. As described hereinbefore the printing elements are disposed in a row transversely to the direction of feed of mail items and hence by a succession of selective operations of the printing elements during passage of the mail item past the printing elements, the required printed impression is built up column by column along the mail item. Upon selective operation of a thermal printing element, the area of ink layer of the ribbon adjacent the operated printing element is heated and is thereby transferred to the surface of the mail item. Data defining the fixed invariable parts of the franking impression is stored in a franking print data memory 29.

Figure 3:
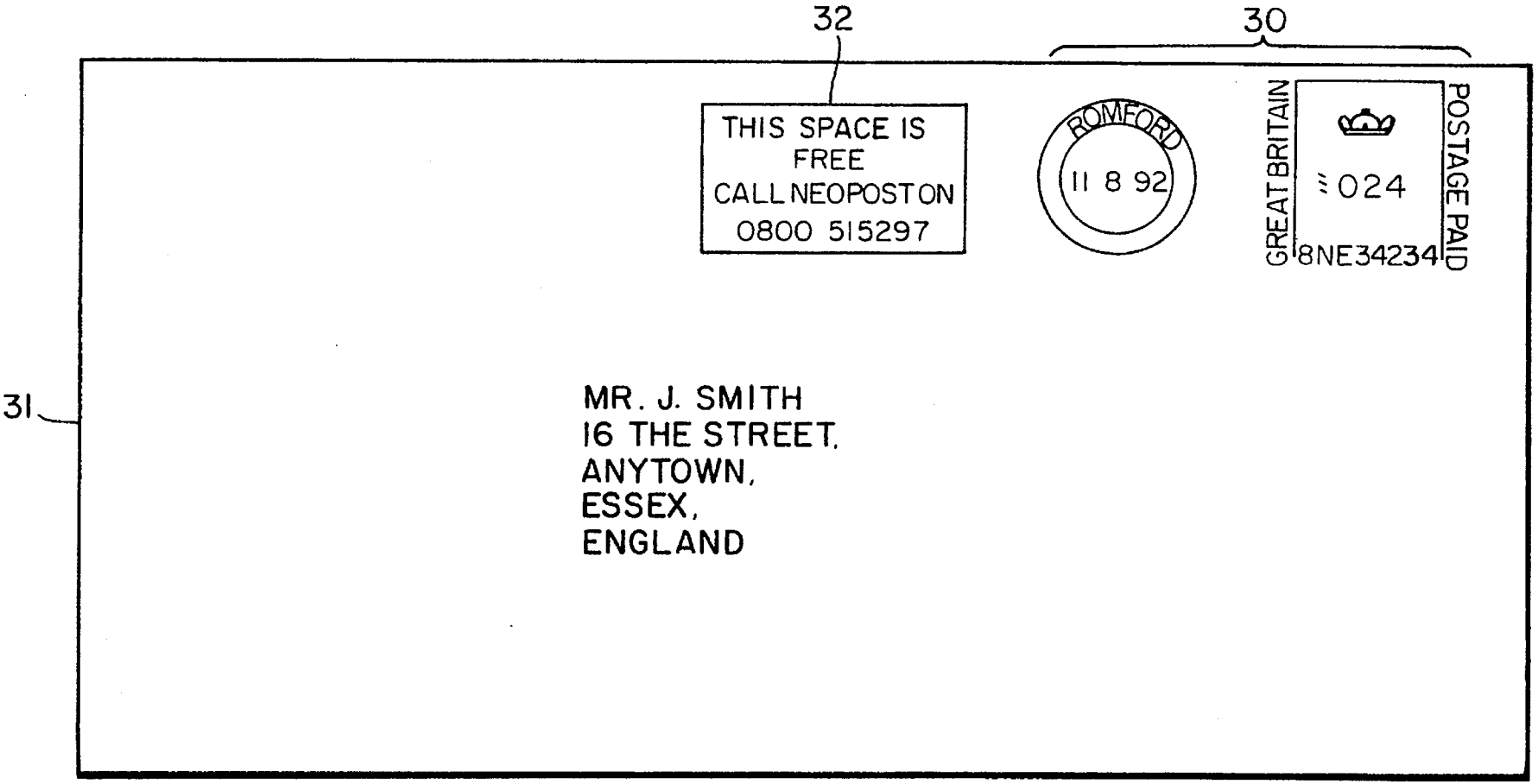
FIG. 3 illustrates a printed franking impression together with a printed slogan.

When a franking operation is to be performed, a user enters by means of the keyboard 25 a postage charge with which an item to be franked and the microprocessor 24 carries out accounting procedures in which the required postage charge is checked against funds stored in the descending register available for use in franking. If the check indicates that there is sufficient credit available the microprocessor proceeds with a program routine whereby the account data stored in the registers is updated to account for the current franking operation being performed and then controls the print head 16 to print a franking impression 30 on an envelope 31 as shown in FIG. 3. Control of the print head 16 by the microprocessor includes merging of print data signals read from the memory 29 relating to the invariable part of the franking impression with print data signals generated by the microprocessor relating to the postage charge and the date and then outputting the merged print data signals to the print head to cause the thermal print elements to be selectively energised in a series of print cycles to print the complete franking impression including the postage charge and date. When it is desired to print a slogan 32 alongside the franking impression, print data signals defining the slogan to be printed are stored in a non-volatile slogan memory 33. The microprocessor reads print data signals from the slogan memory 33 and, after outputting the print data signals defining the franking impression to the printer, the microprocessor outputs the print data signals defining the slogan 32. Accordingly when the envelope is fed past the print head, first the franking impression 30 is printed in a column-by-column manner in the upper right hand part of the envelope and then the slogan is printed in column by column manner to the left of the franking impression.

While a single slogan may be sufficient for the needs of some users of franking machines other users may wish to be able to change the slogan printed as may be desired. This may be achieved by loading the slogan memory 33 with a plurality of print data sets defining a plurality of different slogans respectively. When an operator desires to frank a mail item, the operator inputs not only the desired postage charge on the keyboard but also selects a desired one of the different slogans. The microprocessor operates under a program routine which effects read out of that one of the print data sets corresponding to the slogan selected by the operator to be printed. If desired the slogan printed may default to a predetermined one of the slogans if the operator does not select a slogan or a selected slogan may continue to be printed until such time as the operator inputs a selection of a different slogan.

The slogan memory may be loaded with the print data sets defining a plurality of chosen slogans when the franking machine is installed at a user's location. However the requirements of the user may change over a period of time and the user may wish to be able to print from a selection of slogans different from that currently stored in the memory 33.

As is well known, in order to prevent fraudulent use of the franking machine the circuits carrying out accounting and control functions need to be maintained secure and accordingly these circuits are housed in a secure housing and access to the interior of the housing is permitted only by authorised personnel of the postal authority or of the franking machine supplier or their agents. It is desirable to provide means whereby a user of the franking machine can change any selected one or more of the print data sets defining the slogans and stored in the memory 33 without any possibility of the user obtaining access to those circuits in the secure housing which need to be maintained secure.

The present invention provides a convenient and secure means of changing the slogans stored in the machine. A plurality of sensor cells 34 is disposed below the feed bed 10 of the franking machine in a row extending transversely to the direction of feed of mail item items indicated by arrow 18. A light source 35 is disposed adjacent the row of sensor cells 34. Light from the source 35 illuminates, through a slit 36 in the feed bed 10, a narrow transverse strip of an item positioned on the feed bed. The illuminated transverse strip of the item is sensed by the sensor cells 34. When it is desired to change a stored slogan, a new slogan is drawn or printed on an input item comprising a slogan form and, with the franking machine operating in a slogan input mode, the slogan form is fed by the input rollers past the slit in the feed bed so that the slogan on the form is sensed column by column during feeding of the form. The electrical outputs of the sensor cells are scanned and the resultant data in bit mapped form is input to the microprocessor which then writes the data to the slogan memory 33. While the slogan print data may be stored in the form as received from the sensor cells, it is preferred to store the data in compressed form in order to reduce the memory capacity required. During the slogan input mode of operation, the impression roller may be maintained spaced from the print head to avoid feeding and resultant wastage of ink ribbon. The slogan is located at a position on the form in relation to a leading edge of the form such that when subsequently printed together with a franking impression, the slogan is correctly located relative to the franking impression. If desired the form may carry marking to indicate boundary limits for the slogan.

It is preferred that the number of sensor cells corresponds to the number of thermal print elements of the print head and that the sensor cells are disposed at the same pitch as the thermal printing elements. However if desired a multiple, for example 2 x, of sensor cells as compared with printing elements may be provided. It will be appreciated, that if the sensor cells correspond in number and pitch to the printing elements, the bit mapped data input to the microprocessor will correspond directly to print data in bit mapped form which is output to the print head to effect printing of the slogan. The memory 33 may be arranged to provide storage for print data relating to only a single slogan and when a new slogan is sensed in the slogan input mode of operation the currently stored slogan is erased or overwritten. Alternatively the memory 33 may be arranged to provide a plurality of storage registers for slogan print data. When the franking machine is operated in slogan input mode, the user may operate keys of the keyboard to select any one of the registers to erase a slogan currently stored therein and to select one of the registers to receive the print data defining a new slogan read from a slogan form.

After input of the print data defining a new slogan, the user may check that the slogan has been correctly stored by operating the franking machine to print, by means of the print head 16, the slogan on a sheet fed through the franking machine. The franking machine may be operated to print the slogan without printing a franking impression, or the franking machine may be operated to print the slogan and a zero value franking impression. The printing of both slogan and franking impression enables the user to determine that the slogan is correctly positioned in relation to the franking impression.

If desired the slogan print data may be read out from the memory 33 and utilised to display the slogan on the display 26 and the franking machine may be provided with program routines which can be run to enable editing of the slogan. Alternatively, if the franking machine is provided with a communication port 37, the slogan data may be output to a personal computer 38 for editing of the slogan. After editing is completed, the corresponding slogan print data is input to the microprocessor and is written to the memory 33.

I claim:

1. A franking machine including electronic accounting and control circuits; a digital printing device; slogan sensing means; feed means to feed a mail item past said digital printing device and to feed an input item past said slogan sensing means; franking impression memory means to store franking impression data defining a franking impression to be printed; slogan memory means to store slogan data defining a slogan to be printed; said electronic accounting and control circuits being operative to read out said franking impression data from said franking impression memory means and to read out said slogan data from said slogan memory means to control said digital printing device to print a franking impression and a slogan alongside said franking impression on a mail item fed by said feed means past said digital printing device; said slogan sensing means being operable to sense a new slogan carried by the input item fed by said feed means past said slogan sensing means and to output sense signals defining said sensed slogan; and said electronic accounting and control circuits being operative to store said sense signals in said slogan memory to be utilised as said data defining a slogan to be printed alongside said franking impression.

2. A franking machine as claimed in claim 1 wherein the slogan memory includes at least a first register storing a first slogan data defining a first slogan and a second register for storing second slogan data defining a second slogan and wherein the electronic accounting and control circuits are operable in each franking operation to read out a selected one of the first and second slogan data to control the digital printing device to print the selected one of said first and second slogans.

3. A franking machine as claimed in claim 2 wherein the electronic circuits are operable to input the sense signals defining a new slogan into a selected one of the registers.

4. A franking machine as claimed in claim 1 wherein the electronic circuits include means to enable editing of a slogan defined by data stored in the memory.

5. A method of printing an impression including a franking impression of postage information and a slogan adjacent said franking impression by means of a franking machine including feed means to feed mail items past impression printing means comprising the steps of providing the franking machine with slogan storage means; utilising the feed means to feed a medium bearing a slogan to be included in the impression past slogan scanning means to generate slogan print data and storing said slogan print data in the slogan storage means; and, in a franking operation to print an impression on a mail item, reading said slogan print data from said slogan storage means and franking impression data from franking impression storage means and utilising said slogan print data and said franking impression data to control the impression printing means to print said franking impression together with said slogan adjacent said franking impression during feeding of a mail item by said feed means.

* * * * *